United States Patent [19]

Arold

[11] Patent Number: 4,519,744

[45] Date of Patent: May 28, 1985

[54] TURBINE POWER PLANT

[76] Inventor: Frank G. Arold, 145 Hillcrest Blvd., Ypsilanti, Mich. 48197

[21] Appl. No.: 614,422

[22] Filed: May 25, 1984

[51] Int. Cl.[3] ..... F01D 5/04

[52] U.S. Cl. ..... 415/92; 415/202

[58] Field of Search ..... 415/90, 92, 202, 148; 416/197 B; 60/39, 44

[56] References Cited

U.S. PATENT DOCUMENTS

| | | | |
|---|---|---|---|
| 763,397 | 6/1904 | Hodgkinson et al. | 415/202 UX |
| 802,025 | 10/1905 | Wagner | 415/202 X |
| 858,500 | 7/1907 | Dake | 415/202 |
| 2,411,798 | 11/1946 | Matthews | 415/202 UX |

FOREIGN PATENT DOCUMENTS

| | | | |
|---|---|---|---|
| 116494 | 1/1901 | Fed. Rep. of Germany | 415/92 |
| 1281695 | 12/1961 | France | 416/197 B |

*Primary Examiner*—Robert E. Garrett
*Assistant Examiner*—Joseph M. Pitko
*Attorney, Agent, or Firm*—Stephenson and Boller

[57] ABSTRACT

A turbine power plant comprises a rotor and a stator with chambers arranged at intervals around the outer periphery of the rotor. Nozzles are provided at intervals around the stator and direct working fluid toward the periphery of the rotor. Each chamber comprises an intake opening in the outer periphery of the rotor and an inflow path which extends from the intake opening to a reaction surface. Working fluid entering a chamber passes through the inflow path to impinge upon the reaction surface. The direction of flow is such that work is produced on the rotor producing rotation. At the reaction surface, flow is subdivided into two parts extending into two outflow passages on opposite axial sides of the inflow path. The outflow paths extend to exhaust openings in the outer periphery of the rotor on opposite axial sides of the intake opening. The exiting flow of fluid passes through the outflow paths and exhaust openings toward the stator. Sets of vanes are provided on the stator against which the exhausted working fluid impinges producing a reaction and additional work to rotate the rotor.

20 Claims, 3 Drawing Figures

TURBINE POWER PLANT

BACKGROUND AND SUMMARY OF THE INVENTION

This invention relates to a turbine type power plant. More specifically the invention relates to a power plant which is effective to convert the energy of working fluid into rotational energy of a rotor for delivery by a shaft which journals the rotor.

Turbine type power plants find a wide range of applications. They may be used for powering motive vehicles and in turbo-electric generators, by way of example.

Many power plants, such as internal combustion engines which are widely used in the automotive field, possess relatively low efficiency in terms of horsepower output vs. energy input. In the case of the internal combustion engine, large forces are developed at the instant of combustion, but they rapidly diminish on the piston's downstroke. Such engines are often water cooled and have elaborate cooling systems including radiators at which substantial amounts of waste heat are rejected. Such engines also embody elaborate lubrication systems to minimize the effects of friction and wear. Furthermore, in order to minimize the effects of pollution from these engines to atmosphere, the engines are often deliberately operated at less than their already inefficient maximum efficiency. Additional pollution control equipment is associated with these engines to produce this result, and they are wasteful of fuel.

Applicant's pending U.S. patent application Ser. No. 500,260, Filed June 2, 1983 and entitled "POWER PLANT HAVING A FLUID POWERED FLYWHEEL" relates to an improved turbine type power plant.

The present invention is directed to another new and improved turbine type power plant. Like the power plant in applicant's pending application Ser. No. 500,260 a power plant embodying principles of the present invention is capable of improved efficiencies of operation and is also non-polluting.

Briefly, the present invention comprises a rotor having a plurality of chambers distributed around its periphery. Each chamber has an intake opening and a pair of exhaust openings on opposite axial sides of the intake opening. Each chamber comprises an inflow path extending from the intake opening to a reaction surface. The reaction surface is configured with a diverting structure to subdivide the inflow path at the reaction surface into two substantially equal outflow paths extending from the reaction surface to the two associated exhaust openings.

Working fluid is directed by nozzles toward the rotor at points around the periphery so that when each chamber is in registry with a point at which working fluid is introduced, the working fluid passes via the intake opening of the chamber, through the inflow path to impinge upon the reaction surface. The axis of the inflow path is at an angle to radials from the axis of rotation of the rotor whereby the impinging fluid reacting against the reaction surface exerts a force on the rotor at a location spaced from the axis of rotation and having a circumferential component whereby rotation is imparted to the rotor. The reaction surface serves to subdivide the inflow of working fluid into two substantially equal outflows which pass through the two outflow paths to the two exhaust openings.

The rotor is surrounded by a stator, and reaction surfaces are disposed on the stator at the exhaust openings so that the exhausting working fluid impinges upon them. These reaction surfaces are so arranged that the exhausting working fluid exerts force whereby additional thrust is imparted to the rotor. The disclosed configuration for the reaction surfaces on the stator comprises two series of vanes each of which extends completely around the stator a full 360°.

In this way the rotor is operated by the working fluid to develop rotational energy which can be delivered via a shaft which serves to journal the rotor.

The working fluid may be contained in either a closed or an open system. In a closed system the working fluid is recirculated through the system, for example by means of a pump or other type of device. The working fluid is confined to the power plant and is not exhausted. Any suitable working fluid may be used: pressurized liquid, steam, etc., and it can be appreciated that these are of a non-polluting character. Preferably the rotor has a significant mass so that it functions as a flywheel with considerable inertia to power whatever power-consuming device, or devices, may be coupled with the shaft to receive the power output.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
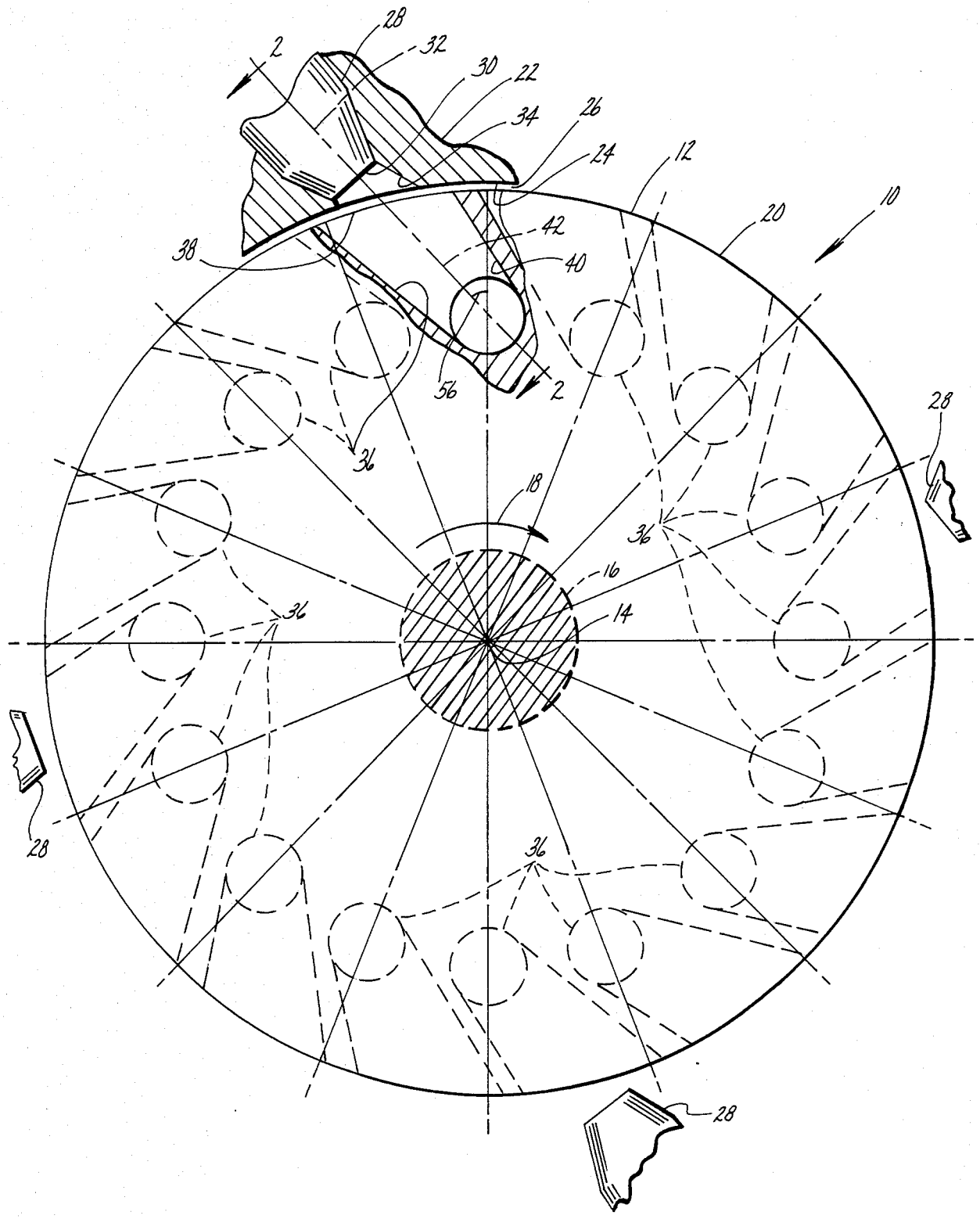
FIG. 1 is an axial view partly in section of a turbine type power plant embodying principles of the present invention.

FIG. 1 illustrates a power plant 10 embodying principles of the present invention. Power plant 10 comprises a rotor 12 which is journaled for rotation about an axis 14 by means of a shaft 16. In operation of power plant 10, rotor 12 rotates in the clockwise sense as indicated by arrow 18.

Rotor 12 is of a circular overall shape having a circular outer periphery 20 which is concentric with axis 14.

A stator 22 is disposed around rotor 12 and has a circular inner periphery 24 which confronts the outer periphery 20 of rotor 12. The dimensions are preferably such that as small a space 26 as possible is left between the rotor and stator.

Working fluid is used to operate rotor 12 and is delivered via one or more nozzles 28 which are arranged at particular locations on stator 22. FIG. 1 illustrates four such nozzles 28 arranged 90° apart about axis 14. Working fluid is delivered to nozzles 28 from a suitable supply (not shown). The working fluid is discharged from each nozzle via its tip 30. It can be seen that the main axis 32 of each nozzle is arranged at an intersecting angle to radials extending from axis 14. Each tip 30 is spaced radially outwardly from the inner circumference 24 of stator 22, and there is a portal passage 34 at the location of each nozzle extending from the nozzle tip 30 to the inner circumference 24 of the stator. Each portal passage 34 tapers outwardly in the direction extending from the nozzle tip end. In this way, the working fluid is directed generally along axis 32 as it is discharged from the nozzle tip.

Rotor 12 is provided with a plurality of chambers 36 which are circumferentially arranged at regular intervals around the periphery of rotor 12. The illustrated embodiment comprises sixteen such chambers whereby the chambers are centered every 22½° around axis 14.

FIG. 1 shows four of the chambers 36 to be in circumferential registry with the four nozzles 28.

Figure 2:
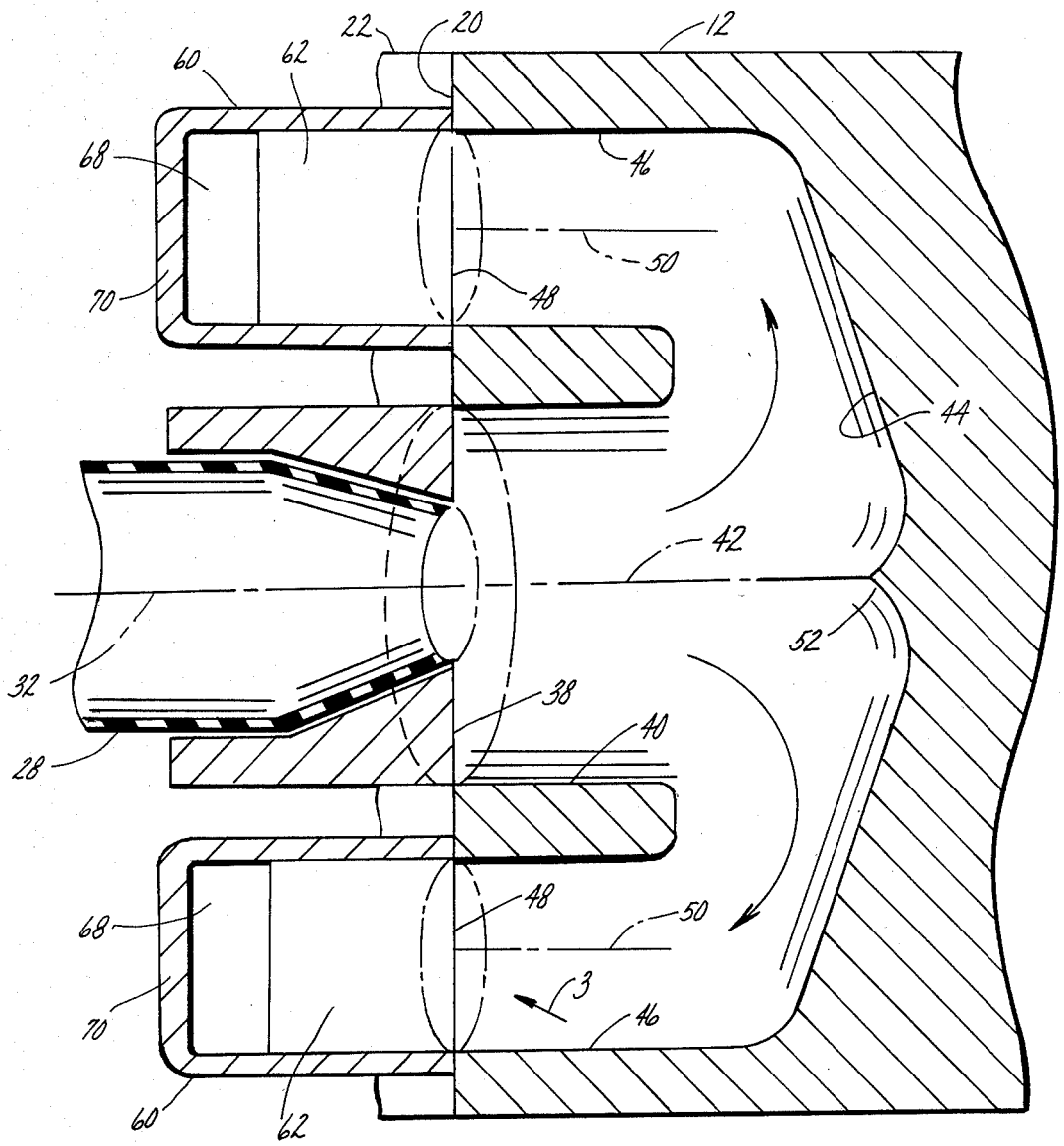
FIG. 2 is a fragmentary cross sectional view on an enlarged scale taken generally in the direction of arrows 2—2 in FIG. 1

Reference is made to both FIGS. 1 and 2 for description of details of the chambers. Each chamber comprises an intake opening 38 which is in registry with portal passage 34 in the position illustrated in the drawing figure. An inflow path 40 extends from intake opening 38 inwardly of rotor 12. As can be seen in FIG. 1 the circumferentially spaced apart wall portions of inflow path 40 taper in a converging sense in the direction from intake opening 38; however, the intake opening may be considered as having a generally circular or elliptical cross section taken transversely to the main axis 42 of the inflow path. In this regard, the axis 42 of each of the four inflow paths in registry with nozzles 28 is shown to be in substantial alignment with the axis 32 of the corresponding nozzle. In this way the working fluid discharged from the tip 30 of each nozzle 28 is directed into the aligned inflow path 40. It can also be appreciated that the inflow path axis is at an intersecting angle to radials from axis 14.

Each chamber 36 further comprises a reaction surface 44 at the end of inflow path 40 opposite intake opening 38. The reaction surface 44 extends axially of axis 14 in opposite directions from the inner end of inflow path 40 with each oppositely extending portion merging into an outflow path 46. In other words there are two outflow paths 46 on axially opposite sides of each inflow path.

Each outflow path 46 terminates at the outer periphery 20 of rotor 12 in an exhaust opening 48. Each outflow path is of generally circular cross sectional shape relative to its axis 50. Each outflow path axis 50 is parallel with the axis 42 of the corresponding inflow path 40.

Reaction surface 44 comprises a diverting structure 52 located centrally as viewed in FIG. 2. The working fluid which passes through the inflow path to impinge upon reaction surface 44 is caused to subdivide into two parts with each subdivided part passing along the reaction surface and into the corresponding outflow path 50. The diverting structure 52 serves to facilitate the subdivision of the working fluid inflow.

Chamber 36 may be considered as having an axial path at where the inflow and outflow paths merge, and this axial path is shown to have a generally circular cross section as seen in FIG. 1 but it will be appreciated that the reaction surface 44 is at a slightly inclined angle from normal to the axes 42 and 50 of the inflow and outflow paths. If the axis of the axial path is projected to where it intersects axis 42, axis 42 is seen to make an intersecting angle 56 of approximately 40° to 45° to a radial from axis 14 at that point.

Disposed in registry with the two sets of exhaust openings 48 are two sets of vanes each of which is designated by the general reference numeral 60. Each set 60 is mounted on stator 22 and extends a full 360° around the stator. Hence, the exhaust openings 48 on one axial side of inflow passage 40 face one of the vane sets 60 and the exhaust openings 48 on the opposite axial side face the other vane set 60.

Figure 3:
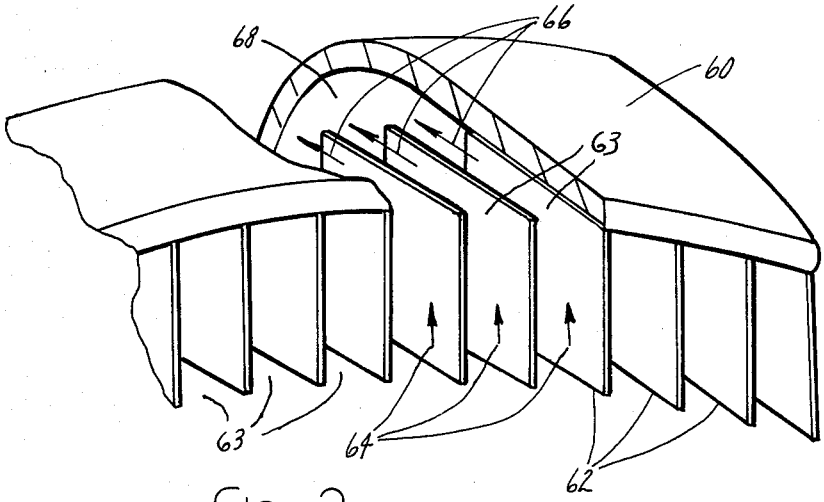
FIG. 3 is a perspective view taken generally in the direction of arrow 3 in FIG. 2.

Each set of vanes comprises a plurality of individual circumferentially spaced apart, axially and radially extending vanes 62. These are shown in detail in FIG. 3.

Each vane 62 of the disclosed embodiment is flat and straight. The blades are uniformly circumferentially spaced apart and define flow channels 63 between immediately adjacent vanes. The vanes are so arranged at an angle to the direction of flow of fluid coming from the rotor that the fluid which exits an exhaust passage 48 impinges upon them. The fluid impinges in the direction of arrows 64 and acts upon the radially inner margins of the vanes which confront the rotor at an angle to the direction of flow from the exhaust passages. After impinging, the flow continues through the flow channels 63 as represented by arrows 66.

The construction of each vane set 60 comprises a circular U-shaped body 70 to which the individual vanes are suitably secured by any conventional means. A header space 68 is provided at the ends of flow channels 63 through which fluid is conducted away to an outlet or pipe (not shown).

The operation of the power plant may be described as follows.

Assume that rotor 12 is in the position shown in FIG. 1 in relation to stator 22. Working fluid which is discharged from each nozzle 28 passes into and through an inflow path 40 to impinge upon a reaction surface 44. Because the direction of flow is at an angle to radials from axis 14 the force of the working fluid acting upon reaction surface 44 will have a component in the clockwise direction. Hence, each nozzle discharge is effective to impart rotation to the rotor in the clockwise sense as indicated by arrow 18 in FIG. 1. The character of the flow of the working fluid is such that while an intake opening is in registry with a nozzle, there is a flow through the chamber to the exhaust openings 48. The exiting flow from the exhaust openings acts upon vanes 62 with the vanes being so arranged that the impingement against them provides a reaction force which has a component in the clockwise sense of arrow 18. Hence the working fluid is utilized in both inflow and outflow to produce work on the rotor. Moreover, by splitting the outflow into two on opposite axial sides of the inflow there is a tendency toward a more balanced condition.

While principles of the invention may be utilized with various types of working fluids, for example liquids, gases or steam, use of a thermal working fluid such as steam is effective to produce work on the rotor even after the intake opening of a chamber leaves registry with a nozzle. In other words after an intake opening of a chamber leaves registry with a nozzle there will be a certain amount of steam within the chamber which seeks to expand and exhaust through the exhaust port and in doing so acts upon the vanes since the vanes are arranged continuously a full 360° around the stator.

When a chamber arrives at the next nozzle, the nozzle will be effective to produce an impingement force on the reaction surface 44 and concurrently a flow through to the exhaust ports acting upon the vanes 62 so long as the intake port remains in registry with the nozzle. The nozzle also serves to replenish the chamber so that work can continue to be repeated after the chamber moves out of registry with that nozzle by virtue of the action of the expanding steam on the vanes.

In overall operation the illustrated embodiment will be effective on four cylinders at a time by the introduction of working fluid into those chambers. If a thermal medium, or a pressurized medium, is used as the fluid, each chamber may be effective to produce additional work by the expanding fluid acting upon vanes 62 after the intake opening for the chamber has moved out of registry with the corresponding nozzle. As can be seen in the illustrated construction, all chambers are of substantially uniform size and shape. The specific dimensioning and construction of a power plant embodying principles of the invention can be made through the use of conventional engineering calculations. Depending upon application it may be beneficial to provide wiping seals on the rotor between the chambers which seal between the rotor and stator.

Based upon the foregoing, one can perceive that the invention provides an improved turbine power plant which possesses the advantages enumerated above.

While a preferred embodiment of the invention has been disclosed, it will be appreciated that principles are applicable to other embodiments.

What is claimed is:

1. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening toward its reaction surface and subdividing at said reaction surface into a pair of outflow paths from its reaction surface to corresponding ones of the associated exhaust openings, and reaction surfaces on said stator against which working fluid exiting said exhaust openings impinges, the reaction surfaces on said stator being arranged in relation to the rotor chambers' reaction surfaces such that the fluid exiting the rotor and impinging on said stator reaction surfaces augments the rotation of the rotor which is produced by impingement of the fluid from said fluid delivery means on the rotor chambers' reaction surfaces.

2. A power plant as set forth in claim 1 in which said peripheral portion of said rotor is the outer circumference of said rotor, said stator being disposed radially outwardly of said rotor.

3. A power plant as set forth in claim 2 in which the pair of said exhaust openings for each chamber are disposed on axially opposite sides of the associated intake opening.

4. A power plant as set forth in claim 3 in which each chamber has axes for its inflow and outflow paths which are at intersecting angles to radials from the axis of rotation.

5. A power plant as set forth in claim 4 in which the inflow and outflow path axes of each chamber are at about a 40° to 45° angle to a radial from the axis of rotation to where the flow of working fluid through each chamber passes from the inflow path to the outflow paths.

6. A power plant as set forth in claim 5 in which each chamber comprises sidewalls circumferentially spaced apart and arranged in a converging sense in the direction of the flow of working fluid through the inflow path.

7. A power plant as set forth in claim 6 in which said fluid delivery means comprises one or more nozzles on said stator each arranged to have its axis substantially aligned with the axis of an inflow path when the corresponding intake opening is registered with the nozzle.

8. A power plant as set forth in claim 4 including diverting structure at each chamber reaction surface to facilitate the subdivision of working fluid as the working fluid passes from the inflow path to the outflow paths.

9. A power plant as set forth in claim 8 in which each chamber is constructed and arranged to provide a substantially equal subdivision of the flow of working fluid into its outflow paths.

10. A power plant as set forth in claim 3 in which said reaction surfaces on said stator comprise two series of circumferentially spaced apart vanes against which working fluid exhausted from each chamber's exhaust openings impinges to provide thrust for the rotor.

11. A power plant as set forth in claim 1 in which each chamber has its inflow and outflow paths parallel, and each inflow and outflow path has an axis which is at an intersecting angle to radials from the axis of rotation.

12. A power plant as set forth in claim 11 in which said fluid delivery means comprises one or more nozzles on said stator, and said reaction surfaces on said stator comprise spaced apart vanes against which the exhausting working fluid is operative to provide thrust to the rotor.

13. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening toward its reaction surface and subdividing at said reaction surface into a pair of outflow paths from its reaction surface to corresponding ones of the associated exhaust openings, and reaction surfaces on said stator against which working fluid exiting said exhaust openings impinges, said peripheral portion of said rotor being the outer circumference of said rotor, said stator being disposed radially outwardly of said rotor, the pair of said exhaust openings for each chamber being disposed on axially opposite sides of the associated intake opening, said reaction surfaces on said stator comprising two series of circumferentially spaced apart vanes against which working fluid exhausted from each chamber's exhaust openings impinges to provide thrust for the rotor, and in which said vanes comprise portions against which the exhausting working fluid impinges and straight channels extending away from said portions.

14. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening toward its reaction surface and subdividing at said reaction surface into a pair of outflow paths from its reaction surface to corresponding ones of the associated exhaust openings, and reaction surfaces on said stator against which working fluid exiting said exhaust opening impinges, said peripheral portion of said rotor being the outer circumference of said rotor, said stator being disposed radially outwardly of said rotor, the pair of said exhaust openings for each chamber being disposed on axially opposite sides of the associated intake opening, said reaction surfaces on said stator comprising two series of circumferentially spaced apart vanes against which working fluid exhausted from each chamber's exhaust openings impinges to provide thrust for the rotor, and in which each series of said vanes extends completely around said stator a full 360°.

15. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening toward its reaction surface and subdividing at said reaction surface into a pair of outflow paths from its reaction surface to corresponding ones of the associated exhaust openings, and reaction surfaces on said stator against which working fluid exiting said exhaust openings impinges, each chamber having its inflow and outflow paths parallel, and each inflow and outflow path having an axis which is at an intersecting angle to radials from the axis of rotation, said fluid delivery means comprising one or more nozzles on said stator, and said reaction surfaces on said stator comprising spaced apart vanes against which the exhausting working fluid is operative to provide thrust to the rotor, and in which there are provided a plurality of said nozzles at selected locations around the axis of rotation and said vanes extend a full 360° around said stator.

16. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening toward its reaction surface and subdividing at said reaction surface into a pair of outflow paths from its reaction surface to corresponding ones at the associated exhaust openings, and reaction surfaces on said stator against which working fluid exiting said exhaust openings impinges, each chamber having its inflow and outflow paths parallel, and each inflow and outflow path having an axis which is at an intersecting angle to radials from the axis of rotation, said fluid delivery means comprising one or more nozzles on said stator, and said reaction surfaces on said stator comprising spaced apart vanes against which the exhausting working fluid is operative to provide thrust to the rotor, and in which said vanes comprise a portion against which exhausting working fluid impinges and a straight flow channel extending away from said portion.

17. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening for reception of working fluid from said fluid delivery means, a reaction surface at the interior of each chamber against which the working fluid impinges, each chamber having a pair of exhaust openings on opposite sides of the associated intake opening, each chamber having an inflow path for working fluid extending from its intake opening towards its reaction surface and subdividing at said reaction surface into a pair of outflow paths from its reaction surface to corresponding ones of the associated exhaust openings, and reaction surfaces on said stator against which working fluid exiting said exhaust openings impinges, in which said peripheral portion of said rotor is the outer circumference of said rotor, and said stator is disposed radially outwardly of and extends around said rotor, said exhaust openings for each chamber being disposed on axially opposite sides of the corresponding intake opening, and the axes of the inflow and the outflow paths for each chamber being at intersecting angles to radials from the axis of rotation, said fluid delivery means comprising a number of nozzles lesser in number than the number of said chambers with said nozzles being located at particular circumferential locations around the axis of rotation, and said reaction surfaces on said stator comprising two circumferentially extending series of axially and radially extending vanes, one series being axially registered with those exhaust openings to one axial side of said intake openings and the other series being axially registered with the exhaust openings on the opposite axial side of said intake openings, said two series of vanes each extending a full 360° around said stator.

18. A power plant as set forth in claim 17 in which each chamber includes diverter structure at its reaction surface for facilitating the subdivision of working fluid as the working fluid passes from the inflow path into the outflow paths.

19. A power plant as set forth in claim 18 in which said chambers are uniformly circumferentially arranged around said rotor and are of substantially identical size and shape.

20. A power plant comprising a rotor journaled about an axis of rotation via a shaft through which useful power is delivered, a stator disposed adjacent a peripheral portion of said rotor, and means for operating said rotor comprising fluid delivery means on said stator for directing working fluid toward said peripheral portion of said rotor and chambers disposed at intervals around said peripheral portion of said rotor, each chamber having an intake opening through which working fluid from said fluid delivery means passes to impinge on a reaction surface, and an exhaust opening through which fluid passes from said rotor after impinging upon said reaction surface, and reaction surfaces on said stator against which working fluid exiting said exhaust opening impinges, said stator reaction surfaces being arranged relative to the rotor chambers' reaction surfaces such that fluid exiting said exhaust openings and impinging on said stator reaction surfaces augments the rotation of said rotor which is produced by the impingement of the fluid from said fluid delivery means on the rotor chambers' reaction surfaces.

* * * * *